US005649334A

United States Patent [19]

Henriquez et al.

[11] Patent Number: 5,649,334

[45] Date of Patent: Jul. 22, 1997

[54] WATER AND SOAP DISPENSING SCRUBBER APPARATUS

[76] Inventors: Jorge de Jesus Matias Henriquez; Evelia G. Matias, both of 14523 SW 172nd La., Miami, Fla. 33177

[21] Appl. No.: 612,237

[22] Filed: Mar. 7, 1996

[51] Int. Cl.[6] ..... A46B 13/04

[52] U.S. Cl. ..... 15/29; 15/97.1

[58] Field of Search ..... 15/24, 29, 97.1

[56] References Cited

U.S. PATENT DOCUMENTS

| | | | |
|---|---|---|---|
| D. 308,443 | 6/1990 | Vetter | D4/131 |
| 1,604,500 | 10/1926 | Tannenbaum | 15/29 |
| 1,625,792 | 4/1927 | Carrington | 15/29 |
| 2,800,313 | 7/1957 | Targosh et al. | 15/29 X |
| 3,114,924 | 12/1963 | Morrison | 15/29 X |
| 3,638,264 | 2/1972 | Walton | 15/29 X |
| 3,864,780 | 2/1975 | Watkins | 15/29 |
| 3,932,909 | 1/1976 | Johnson et al. | 15/29 |
| 4,254,526 | 3/1981 | Fromm | 15/29 |
| 4,335,481 | 6/1982 | Slayman | 15/29 |
| 4,397,056 | 8/1983 | Miller | 15/22.1 |
| 4,799,280 | 1/1989 | Lee | 15/29 |
| 4,893,957 | 1/1990 | Byriel | 401/146 |
| 5,165,132 | 11/1992 | Giorgio et al. | 15/22.2 |
| 5,423,102 | 6/1995 | Madison | 15/22.2 |

FOREIGN PATENT DOCUMENTS

| | | | |
|---|---|---|---|
| 1281617 | 12/1961 | France | 15/29 |
| 2636811 | 2/1978 | Germany | 15/29 |
| 3713443 | 2/1989 | Germany | 15/29 |
| 2180444 | 4/1987 | United Kingdom | 15/29 |

*Primary Examiner*—Mark Spisich

[57] ABSTRACT

A primary fluid, e.g. water, and auxiliary fluid, e.g. soap, dispensing scrubber apparatus includes a pistol-shaped housing which has a hand-grip portion and a scrubber-holder portion. A primary fluid conveyance assembly includes, in sequence, an inlet end, a pre-valve conduit, a valve assembly, a post-valve conduit, and an outlet end. A flexible hose has one end connected to the inlet end of the primary fluid conveyance assembly and has another end which includes a faucet connector. Rechargeable batteries are housed within the housing and power a DC motor. A trigger-containing switch assembly is connected between the motor and the batteries. A drive shaft is connected to the motor, and a scrubber head is connected to the drive shaft. A spray nozzle is connected to the outlet end of the post-valve conduit. The drive shaft is hollow and forms a portion of the post-valve conduit of the primary fluid conveyance assembly. A fluid-tight seal is connected between a lead-in portion of the post-valve conduit and the hollow drive shaft. A motor armature includes a hollow armature shaft which serves as the drive shaft and also forms a portion of the post-valve conduit of the primary fluid conveyance assembly. The scrubber head may be in the form of a brush or a sponge. A container assembly, connected to the housing, contains a quantity of an auxiliary fluid which is moved to the valve assembly through a feed tube.

13 Claims, 3 Drawing Sheets

FIG 1
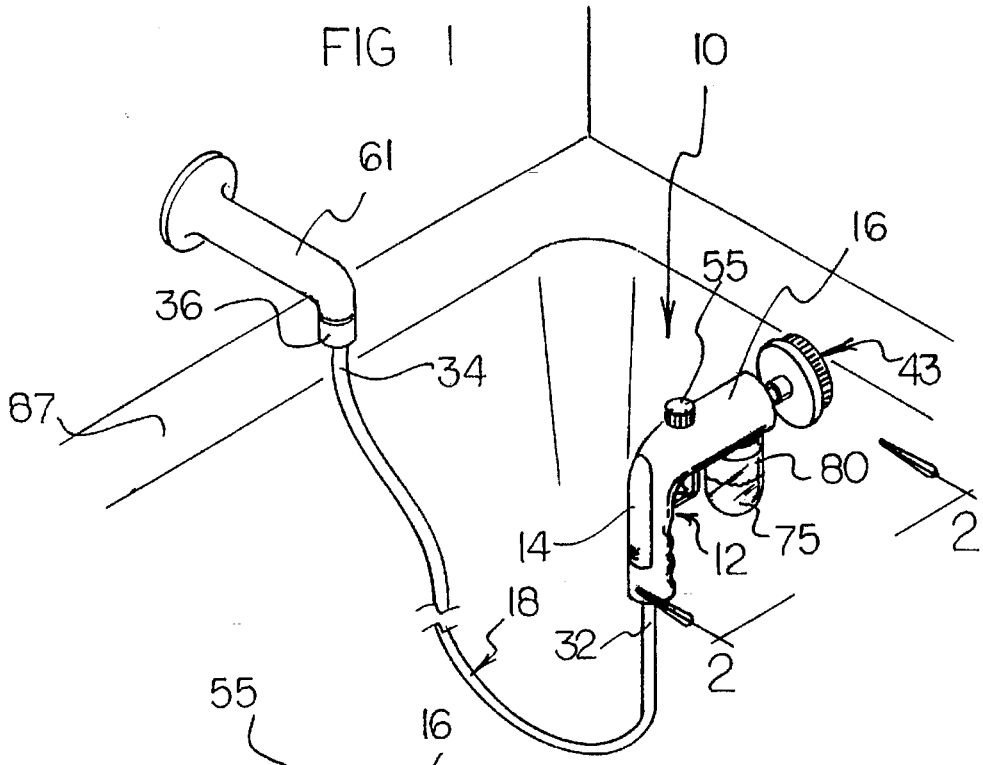
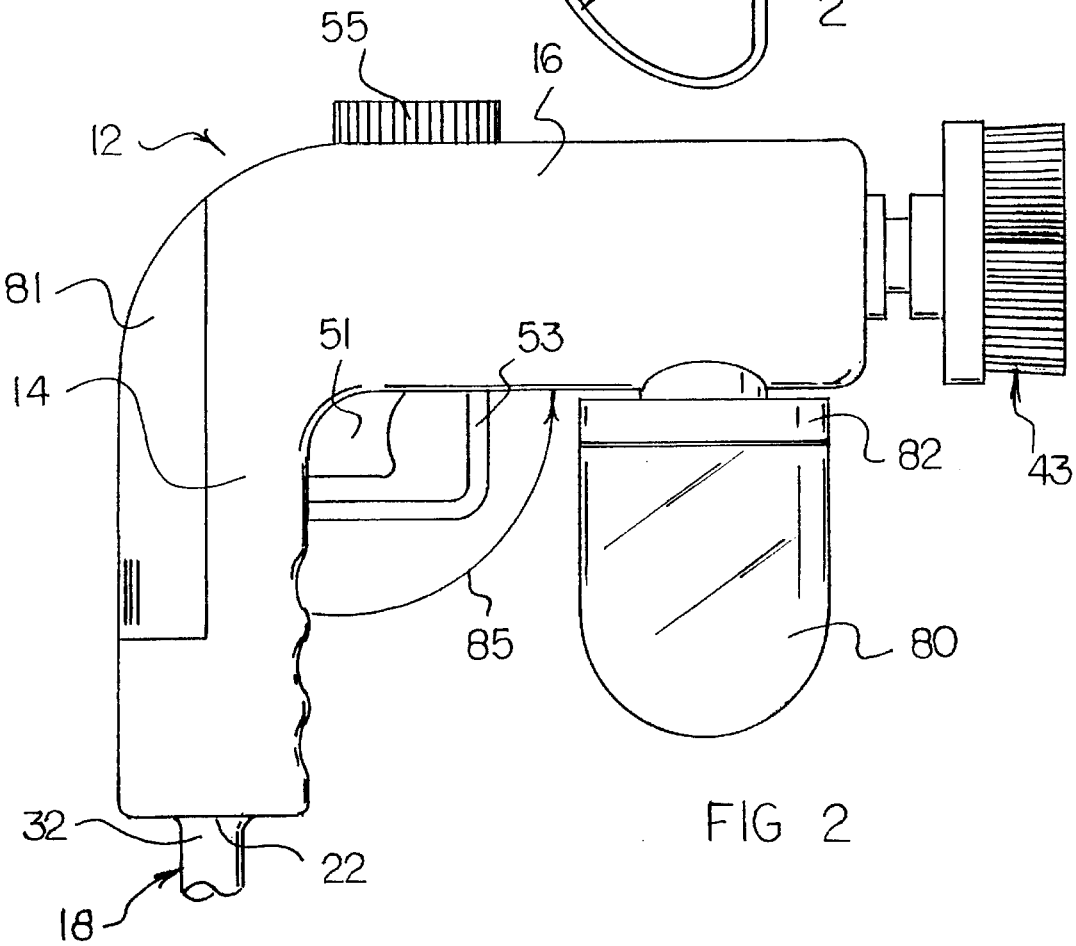
FIG 2

FIG 3
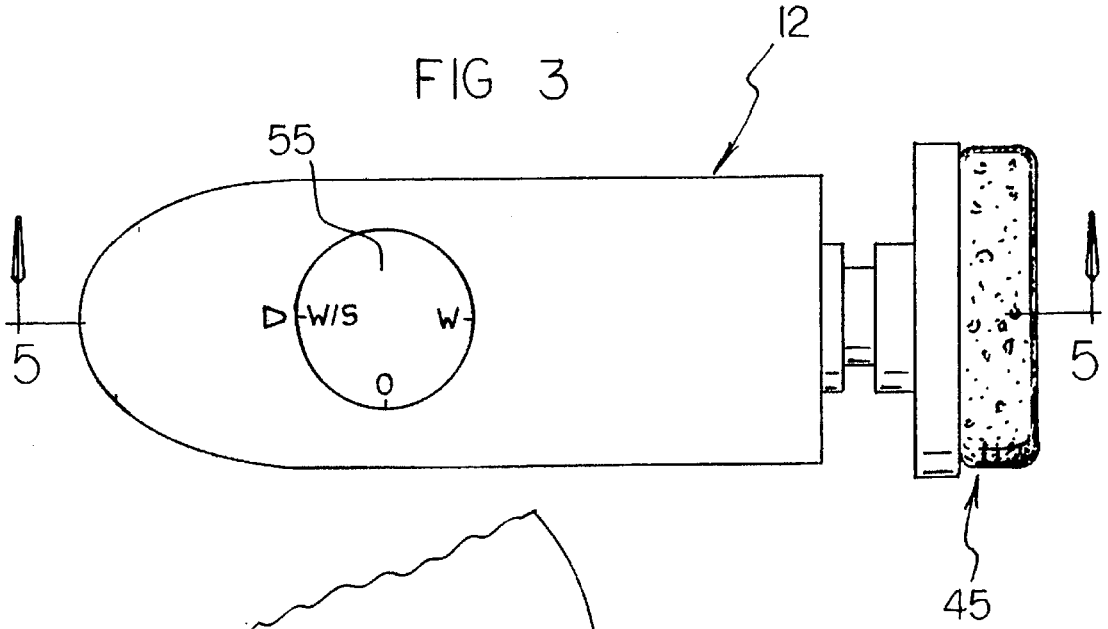
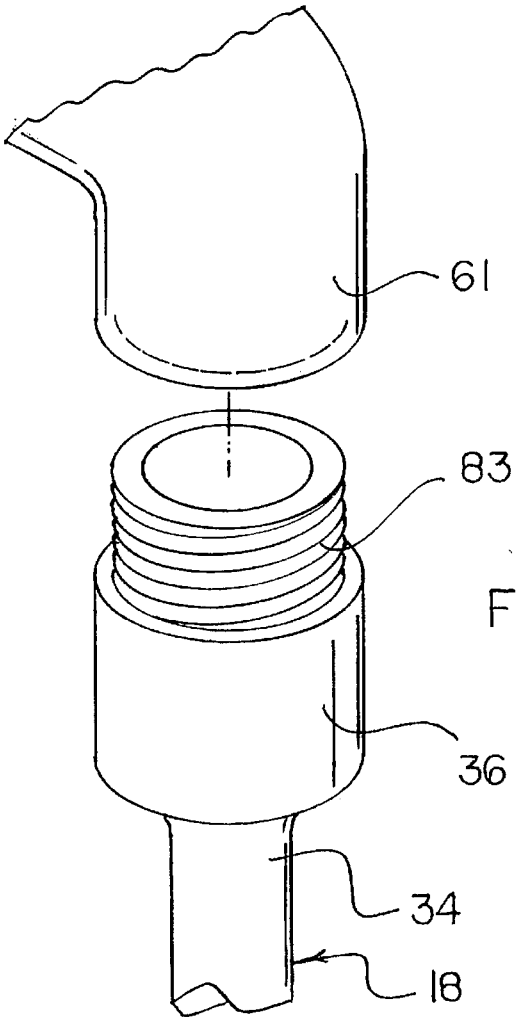
FIG 4

WATER AND SOAP DISPENSING SCRUBBER APPARATUS

BACKGROUND OF THE INVENTION

1. Field of the Invention

The present invention relates generally to cleaning implements and, more particularly, to cleaning implements that include a soap supply and a cleaning brush.

2. Description of the Prior Art

A house has many areas that must be cleaned periodically. For purposes of overall health and sanitation, bathroom areas often require special cleaning efforts. In bathrooms, the toilet, the tub and shower, the walls, and the sink must all be cleaned. To efficiently remove dirt, a quantity of soap or detergent and a brush are often employed. The combination of soap and brush is so common that throughout the years, a number of innovations have been developed relating to devices which combine both soap and a brush, and the following U.S. patents are representative of some of those innovations: U.S. Pat. Nos. 3,932,909, 4,397,056, 4,893,957, and 5,423,102. More specifically, each of U.S. Pat. Nos. 3,932,909 and 4,893,957 discloses a self-powered scrub brush. A person using this device provides a manual squeezing action to dispense soap to the brush portion of the device. Since the scrubbing action itself can be very laborious and tiring, it would be desirable if a cleaning brush did not require a manual pumping action to dispense soap at a cleaning brush.

U.S. Pat. No. 4,397,056 discloses battery-power assisted toilet brush that moves a brush head in a reciprocal action and that dispenses soap to the brush head. Although soaping and scrubbing are important cleaning functions that are assisted by this device, another important cleaning function is not addressed by this device. The missing cleaning function is rinsing. Once dirt is scrubbed off of a surface, the dirt and soap must be rinsed away in order that the surface be clean. In this respect, it would be desirable if a soap dispensing scrub brush had means for rinsing a soaped and scrubbed surface.

U.S. Pat. No. 5,423,102 discloses a portable cleaning device that includes a motorized brush and a quantity of soap. This device does not have provisions for rinsing a soaped and brushed surface.

U.S. Pat. No. 5,165,132 may be of interest for its disclosure of a reciprocating brush that is powered by a stream of pressurized water. U.S. Pat. No. Des. 308,443 may be of interest for its disclosure of a non-soap-dispensing toilet brush.

Still other features would be desirable in a soap dispensing brush apparatus. To facilitate rinsing of a soaped and brushed surface, it would be desirable if a soap dispensing brush apparatus could be connected to a faucet to supply rinse water. Rather than have a person manually pump a quantity of soap to a brush head, it would be desirable if a soap dispensing brush apparatus could employ flowing water to suck up soap and transport it to a brush head. To prevent surfaces that are being rinsed from coming into contact with additional soap, it would be desirable if a manually controlled valve could cut off a flow of soap to a water stream. To provide efficient brushing action, it would be desirable if a soap dispensing brush apparatus included a powered brush.

There may be times when it would be desirable to employ a sponge-containing head rather than a brush head for certain purposes. In this respect, it would be desirable if a soap dispensing brush apparatus had a brush head that is readily removed and replaced with a sponge-containing head.

To be economical in both material and energy costs, to provide power to a brush head, it would be desirable if a soap dispensing brush apparatus were powered by an electric motor that is powered with rechargeable batteries.

An important feature of any implement is how it fits into a person's hand, that is how it is grasped. A pistol shape is a popular shape for a number of hand-held objects, and it would be desirable if a soap dispensing brush apparatus had an overall pistol shape.

A pistol generally has a trigger, and a trigger-like switch operator is employed with a number of devices. In this respect, it would be desirable if a soap dispensing brush apparatus employed a trigger-like switch operator for controlling power to a brush head. It is noted that with a pistol shape, the hand grip portion is at an angle which ranges from a right angle to an obtuse angle with respect to the working end of the implement. In this respect, it would be desirable if a soap dispensing brush apparatus had a hand grip portion that is at an angle which ranges from a right angle to an obtuse angle with respect to the working end of the apparatus.

Thus, while the foregoing body of prior art indicates it to be well known to use soap dispensing brush devices, the prior art described above does not teach or suggest a water and soap dispensing scrubber apparatus which has the following combination of desirable features: (1) does not require a manual pumping action to dispense soap at a cleaning brush; (2) has means for rinsing a soaped and scrubbed surface; (3) is connected to a faucet to supply rinse water; (4) employs flowing water to suck up soap and transport it to a brush head; (5) has a manually controlled valve that can cut off a flow of soap to a water stream; (6) includes a powered brush; (7) has a brush head that is readily removed and replaced with a sponge-containing head; (8) is powered by an electric motor that is powered with rechargeable batteries; (9) has an overall pistol shape; (10) has a hand grip portion that is at an angle which ranges from a right angle to an obtuse angle with respect to the working end of the apparatus; and (11) employs a trigger-like switch operator for controlling power to a brush head. The foregoing desired characteristics are provided by the unique water and soap dispensing scrubber apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a primary fluid and auxiliary fluid dispensing scrubber apparatus which includes a pistol-shaped housing assembly which has a hand-grip portion oriented at an angle which ranges from a right angle to an obtuse angle with respect to a scrubber-holder portion. A primary fluid conveyance assembly is housed within the housing assembly. The primary fluid conveyance assembly includes an inlet end, a pre-valve conduit connected to the inlet end, a valve assembly connected to the pre-valve conduit, a post-valve conduit connected to the valve assembly, and an outlet end connected to the post-valve conduit. A flexible hose has a first hose end connected to the inlet end of the primary fluid conveyance assembly and has a second hose end which includes a faucet connector. A motor assembly is housed with the housing assembly as is a power source for powering the motor assembly. A switch assembly is connected between the motor assembly and the power source. A drive shaft is connected to the motor assembly, and a scrubber head assembly is connected to the drive shaft. A spray nozzle is connected to the outlet end of the post-valve conduit.

The drive shaft has a working end which includes an externally threaded connector portion, and the scrubber head assembly includes an internally threaded connector portion for connection to the externally threaded connector portion of the drive shaft. The drive shaft is hollow and forms a portion of the post-valve conduit of the primary fluid conveyance assembly. In addition, a fluid-tight seal is connected between a lead-in portion of the post-valve conduit and the hollow drive shaft.

The motor assembly includes a field magnet supported by the scrubber-holder portion of the housing assembly. An armature assembly includes a coil assembly supported by an armature shaft, and a pair of bearings are connected to the housing assembly, for supporting the armature shaft and permitting rotation thereof. The armature shaft is hollow, serves as the drive shaft, and forms a portion of the post-valve conduit of the primary fluid conveyance assembly. The power source is comprised of rechargeable batteries. The switch assembly includes a trigger-like switch actuator. The scrubber head assembly may be in a form of a brush head assembly.

The valve assembly includes a flow position which permits fluid to flow from the pre-valve conduit to the post-valve conduit and includes a shut-off position which prevents fluid from flowing from the pre-valve conduit to the post-valve conduit.

A container assembly is connected to the housing assembly. The container assembly is used for containing a quantity of an auxiliary fluid. A feed tube is supported by the housing assembly. The feed tube includes an inlet end extending into the container assembly, and an outlet end of the feed tube is connected to the valve assembly. The container assembly includes a lid portion connected to the housing assembly. A container portion is connected to the lid portion, and a vent tube is connected to the lid portion. As fluid level falls in the container portion, replacement air enters the container portion by way of the vent tube.

The valve assembly includes a flow/dispenser position which permits fluid to flow from the pre-valve conduit to the post-valve conduit and which also permits fluid from the feed tube to enter the valve assembly. The valve assembly also includes a shut-off position which prevents fluid from flowing from the pre-valve conduit to the post-valve conduit and which prevents auxiliary fluid from the feed tube from entering the primary fluid. A venturi structure is connected to the feed tube for drawing a quantity of the auxiliary fluid into the valve assembly. The scrubber head assembly can be in a form of a sponge head assembly.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved water and soap dispensing scrubber apparatus which has all of the advantages of the prior art and none of the disadvantages.

It is another object of the present invention to provide a new and improved water and soap dispensing scrubber apparatus which may be easily and efficiently manufactured and marketed.

It is a further object of the present invention to provide a new and improved water and soap dispensing scrubber apparatus which is of durable and reliable construction.

An even further object of the present invention is to provide a new and improved water and soap dispensing scrubber apparatus which is susceptible of a low cost of manufacture with regard to both materials and labor, and which accordingly is then susceptible of low prices of sale to the consuming public, thereby making such water and soap dispensing scrubber apparatus available to the buying public.

Still yet a further object of the present invention is to provide a new and improved water and soap dispensing scrubber apparatus which does not require a manual pumping action to dispense soap at a cleaning brush.

Still another object of the present invention is to provide a new and improved water and soap dispensing scrubber apparatus that has means for rinsing a soaped and scrubbed surface.

Yet another object of the present invention is to provide a new and improved water and soap dispensing scrubber apparatus which is connected to a faucet to supply rinse water.

Even another object of the present invention is to provide a new and unproved water and soap dispensing scrubber apparatus that employs flowing water to suck up soap and transport it to a brush head.

Still a further object of the present invention is to provide a new and improved water and soap dispensing scrubber apparatus which has a manually controlled valve that can cut off a flow of soap to a water stream.

Yet another object of the present invention is to provide a new and improved water and soap dispensing scrubber apparatus that includes a powered brush.

Still another object of the present invention is to provide a new and improved water and soap dispensing scrubber apparatus which has a brush head that is readily removed and replaced with a sponge-containing head.

Yet another object of the present invention is to provide a new and improved water and soap dispensing scrubber apparatus that is powered by an electric motor that is powered with rechargeable batteries.

Still a further object of the present invention is to provide a new and unproved water and soap dispensing scrubber apparatus that has an overall pistol shape.

Yet another object of the present invention is to provide a new and improved water and soap dispensing scrubber apparatus which has a hand grip portion that is at an angle which ranges from a right angle to an obtuse angle with respect to the working end of the apparatus.

Still a further object of the present invention is to provide a new and improved water and soap dispensing scrubber apparatus that employs a trigger-like switch operator for controlling power to a brush head.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a perspective view showing a preferred embodiment of the water and soap dispensing scrubber apparatus of the invention connected to a faucet and in a cleaning position on a bathtub wall as it were being held by a human hand which is not shown.

FIG. 2 is an enlarged side view of the portion of the embodiment of the invention shown in FIG. 1 taken along line 2—2 of FIG. 1.

FIG. 3 is a top view of the portion of the embodiment of invention shown in FIG. 2.

FIG. 4 is an enlarged perspective view showing an end of the flexible hose shown in FIG. 1 about to be connected to the faucet shown in FIG. 1.

DESCRIPTION OF THE PREFERRED EMBODIMENT

Figure 5:
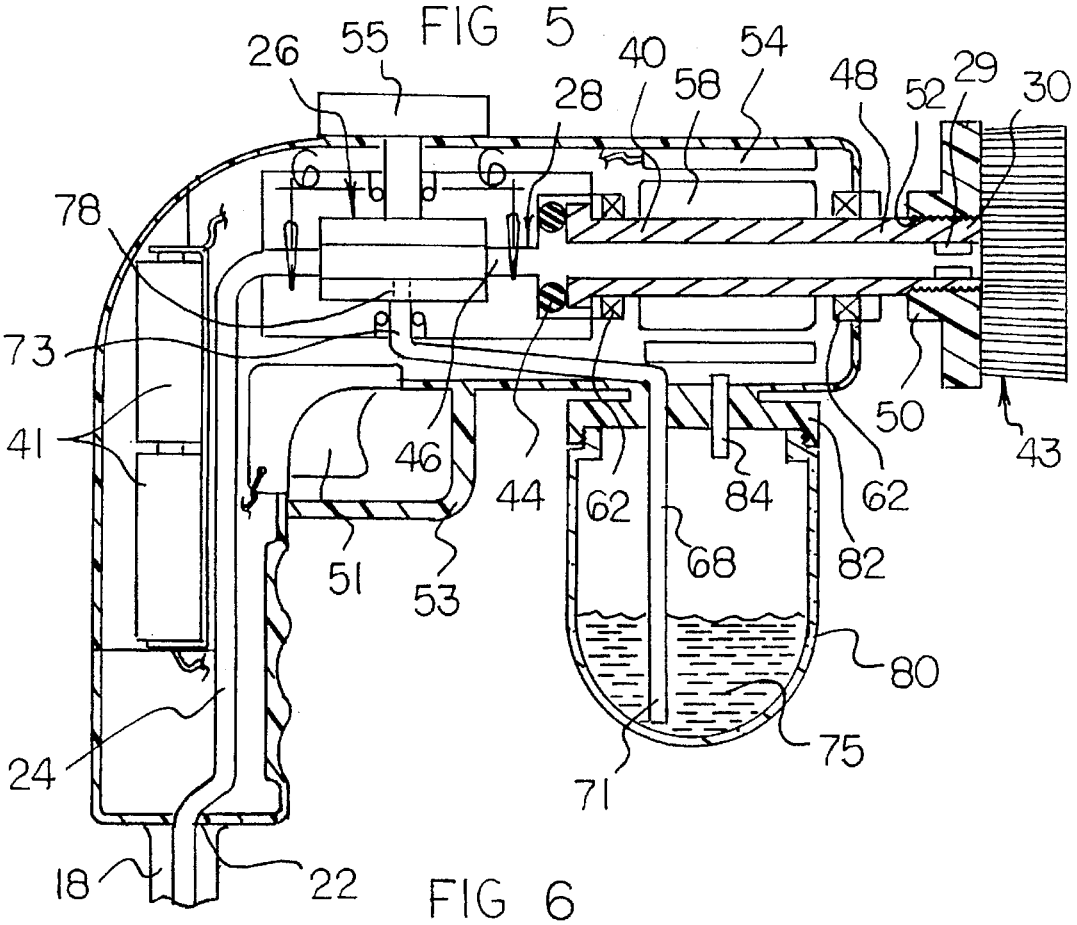
FIG. 5 is a cross-sectional view of the embodiment of the invention shown in FIG. 3 with a brush head substituted for the sponge head shown in FIG. 3.

With reference to the drawings, a new and improved water and soap dispensing scrubber apparatus embodying the principles and concepts of the present invention will be described.

Turning to FIGS. 1–6, there is shown an exemplary embodiment of the water and soap dispensing scrubber apparatus of the invention generally designated by reference numeral 10. In its preferred form, a primary fluid and auxiliary fluid dispensing scrubber apparatus 10 includes a pistol-shaped housing assembly 12 which has a hand-grip portion 14 oriented at an angle which ranges from a right angle to an obtuse angle with respect to a scrubber-holder portion 16. A primary fluid conveyance assembly is housed within the housing assembly 12. The primary fluid conveyance assembly includes an inlet end 22, a pre-valve conduit 24 connected to the inlet end 22, a valve assembly 26 connected to the pre-valve conduit 24, a post-valve conduit 28 connected to the valve assembly 26, and an outlet end 30 connected to the post-valve conduit 28. A flexible hose 18 has a first hose end 32 connected to the inlet end 22 of the primary fluid conveyance assembly and has a second hose end 34 which includes a faucet connector 36 which is connected to a faucet 61. A motor assembly is housed with the housing assembly 12 as is a power source for powering the motor assembly. A switch assembly is connected between the motor assembly and the power source. A drive shaft 40 is connected to the motor assembly, and a scrubber head assembly is connected to the drive shaft 40. Most commonly, the primary fluid conveyance assembly conveys water from a faucet 61. Water is the most universally applicable primary fluid, spray nozzle 29 is connected to the outlet end 30 of the post-valve conduit 28.

The drive shaft 40 has a working end 48 which includes an externally threaded connector portion 50, and the scrubber head assembly includes an internally threaded connector portion 52 for connection to the externally threaded connector portion 50 of the drive shaft 40. The drive shaft 40 is hollow and forms a portion of the post-valve conduit 28 of the primary fluid conveyance assembly. In addition, a fluid-tight seal 44 is connected between a lead-in portion 46 of the post-valve conduit 28 and the hollow drive shaft 40.

The motor assembly includes a field magnet 54 supported by the scrubber-holder portion 16 of the housing assembly 12. An armature assembly includes a coil assembly 58 supported by an armature shaft, and a pair of bearings 62 are connected to the housing assembly 12, for supporting the armature shaft and permitting rotation thereof. The armature shaft is hollow, serves as the drive shaft 40, and forms a portion of the post-valve conduit 28 of the primary fluid conveyance assembly. The power source is comprised of rechargeable batteries 41.

The switch assembly includes a trigger-like switch actuator 51. A trigger guard 53 is provided to protect the trigger-like switch actuator 51 from inadvertent triggering. The scrubber head assembly may be in a form of a brush head assembly 43.

Figure 6:
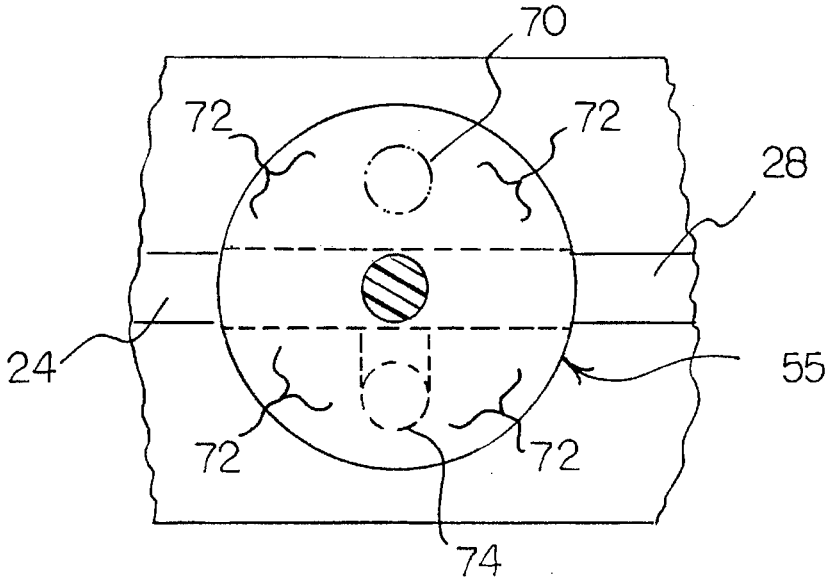
FIG. 6 is an enlarged partial cross-sectional view of the embodiment of the invention shown in FIG. 5 taken along line 6—6 of FIG. 5.

As shown more specifically in FIG. 6, the valve assembly 26 includes a flow position which permits fluid to flow from the pre-valve conduit 24 to the post-valve conduit 28 and includes a shut-off position 72 which prevents fluid from flowing from the pre-valve conduit 24 to the post-valve conduit 28. Actually, four shut-off positions 72 are shown in FIG. 6.

A container assembly is connected to the housing assembly 12. The container assembly is used for containing a quantity of an auxiliary fluid 75. A feed tube 68 is supported by the housing assembly 12. The feed tube 68 includes an inlet end 71 extending into the container assembly, and an outer end 73 of the feed tube 68 is connected to the valve assembly 26. Most commonly, the auxiliary fluid 75 is a liquid soap or detergent which is added to the primary fluid which is usually water. The container assembly includes a lid portion 82 connected to the housing assembly 12. A container portion 80 is connected to the lid portion 82, and a vent tube 84 is connected to the lid portion 82. As fluid level falls in the container portion 80, replacement air enters the container portion 80 by way of the vent tube 84. The lid portion 82 includes internal threads, and the container portion 80 includes complementary external threads, whereby the container portion 80 can be removed from and replaced on the lid portion 82 when more auxiliary fluid 75 is added to the container portion 80.

The valve assembly 26 includes a flow/dispenser position 74 which permits fluid to flow from the pre-valve conduit 24 to the post-valve conduit 28 and which also permits fluid from the feed tube 68 to enter the valve assembly 26. The valve assembly 26 also includes a shut-off position 72 which prevents fluid from flowing from the pre-valve conduit 24 to the post-valve conduit 28 and which prevents auxiliary fluid from the feed tube 68 from entering the primary fluid. A venturi structure 78 is connected to the feed tube 68 for drawing a quantity of the auxiliary fluid 75 into the valve assembly 26. A valve selector knob 55 is provided for operating the valve assembly 26 for selecting he desired valve position. As shown in FIG. 3. The scrubber head assembly may be in a form of a sponge head assembly 45.

In using the primary fluid and auxiliary fluid dispensing scrubber apparatus 10, the container portion 80 of the container assembly is filled with a quantity of auxiliary fluid 75 which may be a quantity of liquid soap or detergent. Then, the, container portion 80 is screwed onto the lid portion 82 of the container assembly. A cover 81 on the housing assembly 12 is removed, and rechargeable batteries 41 are placed in their appropriate reception region within the housing assembly 12. Then the cover 81 is replaced. The rechargeable batteries 41 provide DC electrical power through the switch assembly to a DC motor assembly. The motor assembly drives the brush head assembly 43 or the sponge head assembly 45 through the drive shaft 40 which is connected to the motor assembly. The brush head assembly 43 or the sponge head assembly 45 is rotated in a rotational scrubbing motion by the drive shaft 40.

The faucet connector 36 on the second hose end 34 of the flexible hose 18 is connected to a faucet 61. As shown in FIG. 4, the faucet connector 36 can include external threads 83 which are complementary to internal threads in the faucet 61. The spigots (not shown) which control water flow to the faucet 61 are turned on to allow water pressure to be present in the faucet 61. The valve assembly 26 is initially in one of the shut-off positions 72. If it is desired to have water flow from the faucet 61 to the scrubber head assembly without using any of the auxiliary fluid 75, e.g. liquid soap or detergent, then the valve selector knob 55 is turned to the flow position 70 shown in FIG. 6. When this valve position is selected, no auxiliary fluid 75 is added to the water stream that flows to the spray nozzle 29 and the scrubber head assembly. This valve position is selected when only clean water, such as for rinsing a surface, is to sent to the scrubber head assembly.

On the other hand, if it is desired to employ the auxiliary fluid 75 along with the primary fluid stream, the valve selector knob 55 is turned to select the flow/dispenser position 74, which is the selected valve position shown in FIG. 6. With this position selected, water flows through the valve assembly 26 and flows over the venturi structure 78 in the valve assembly 26. This causes a vacuum to be created at the venturi structure 78. As a result, auxiliary fluid 75 is sucked into the primary fluid stream through the venturi structure 78. More specifically, auxiliary fluid 75 is sucked from the container portion 80 of the container assembly, through the feed tube 68, through the venturi structure 78, and into the stream of primary fluid. This valve position is selected when scrubbing and cleaning a surface is desired.

At any desired time, the scrubber head assembly can be caused to rotate by the user pressing the trigger-like switch actuator 51 of the switch assembly. Such trigger action, completes the electrical circuit for the motor assembly causing the coil assembly 58 and shaft, that is the drive shaft 40, to rotate, whereby the scrubber head assembly is caused to rotate. When finger pressure is released from the trigger-like switch actuator 51, electric power is cut off from the motor assembly, and the scrubber head assembly ceases to rotate.

The length of the flexible hose 18 can be selected so that the primary fluid and auxiliary fluid dispensing scrubber apparatus 10 of the invention can be used throughout a bathroom so that tubs, sinks, toilets, and walls can be cleaned, scrubbed, and rinsed. As shown in FIG. 1, the apparatus of the invention may be used to scrub a bathtub 87.

The arrangement of the complementary threads between the drive shaft 40 and the scrubber head assembly can be provided so that the threads tend to tighten with respect to each other as the drive shaft 40 rotates and as the scrubber head assembly contacts a surface.

As shown in FIG. 2, the angle 85 between the hand-grip portion 14 and the scrubber-holder portion 16 of the housing assembly 12 is a right angle. However, if desired, the angle 85 can also be an obtuse angle as is common with many pistols.

The components of the water and soap dispensing scrubber apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved water and soap dispensing scrubber apparatus that is low in cost, relatively simple in design and operation, and which may advantageously be used without requiring a manual pumping action to dispense soap at a cleaning brush. With the invention, a water and soap dispensing scrubber apparatus is provided which has means for rinsing a soaped and scrubbed surface. With the invention, a water and soap dispensing scrubber apparatus is provided which is connected to a faucet to supply rinse water. With the invention, a water and soap dispensing scrubber apparatus is provided which employs flowing water to suck up soap and transport it to a brush head. With the invention, a water and soap dispensing scrubber apparatus is provided which has a manually controlled valve that can cut off a flow of soap to a water stream. With the invention, a water and soap dispensing scrubber apparatus is provided which includes a powered brush. With the invention, a water and soap dispensing scrubber apparatus is provided which has a brush head that is readily removed and replaced with a sponge-containing head. With the invention, a water and soap dispensing scrubber apparatus is provided which is powered by an electric motor that is powered with rechargeable batteries. With the invention, a water and soap dispensing scrubber apparatus is provided which has an overall pistol shape. With the invention, a water and soap dispensing scrubber apparatus is provided which has a hand grip portion that is at an angle which ranges from a right angle to an obtuse angle with respect to the working end of the apparatus. With the invention, a water and soap dispensing scrubber apparatus is provided which employs a trigger-like switch operator for controlling power to a brush head.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A primary fluid and auxiliary fluid dispensing scrubber apparatus, comprising:

a pistol-shaped housing assembly which has a hand-grip portion oriented at an angle which ranges from a right angle to an obtuse angle with respect to a scrubber-holder portion, a primary fluid conveyance assembly housed within said housing assembly, wherein said primary fluid conveyance assembly includes an inlet end, a pre-valve conduit connected to said inlet end, a valve assembly connected to said pre-valve conduit, a post-valve conduit connected to said valve assembly, and an outlet end connected to said post-valve conduit, a flexible hose having a first hose end connected to said inlet end of said primary fluid conveyance assembly and having a second hose end which includes a faucet connector, a motor assembly housed with said housing assembly, a power source for powering said motor assembly, a switch assembly connected between said motor assembly and said power source, a drive shaft connected to said motor assembly, and a scrubber head assembly connected to said drive shaft, wherein said drive shaft is hollow and forms a portion of said post-valve conduit of said primary fluid conveyance assembly, and further including a fluid-tight seal connected between a lead-in portion of said post-valve conduit and said hollow drive shaft.

2. The apparatus of claim 1, further including:

a spray nozzle connected to said outlet end of said post-valve conduit.

3. The apparatus of claim 1 wherein:

said drive shaft has a working end which includes an externally threaded connector portion, and said scrubber head assembly includes an internally threaded connector portion for connection to said externally threaded connector portion of said drive shaft.

4. The apparatus of claim 1 wherein said motor assembly includes:

a field magnet supported by said scrubber-holder portion of said housing assembly, an armature assembly which includes a coil assembly supported by an armature shaft, and a pair of bearings, connected to said housing assembly, for supporting said armature shaft and permitting rotation thereof.

5. The apparatus of claim 4 wherein said armature shaft of said armature assembly is hollow, serves as said drive shaft, and forms a portion of said post-valve conduit of said primary fluid conveyance assembly.

6. The apparatus of claim 1 wherein said power source is comprised of rechargeable batteries.

7. The apparatus of claim 1 wherein said switch assembly includes a trigger-like switch actuator.

8. The apparatus of claim 1 wherein said scrubber head assembly is in a form of a brush head assembly.

9. The apparatus of claim 1 wherein said valve assembly includes:

a flow position which permits fluid to flow from said pre-valve conduit to said post-valve conduit, and a shut-off position which prevents fluid from flowing from said pre-valve conduit to said post-valve conduit.

10. The apparatus of claim 1 wherein said scrubber head assembly is in a form of a sponge head assembly.

11. A primary fluid and auxiliary fluid dispensing scrubber apparatus, comprising:

a pistol-shaped housing assembly which has a hand-grip portion oriented at an angle which ranges from a right angle to an obtuse angle with respect to a scrubber-holder portion, a primary fluid conveyance assembly housed within said housing assembly, wherein said primary fluid conveyance assembly includes an inlet end, a pre-valve conduit connected to said inlet end, a valve assembly connected to said pre-valve conduit, a post-valve conduit connected to said valve assembly, and an outlet end connected to said post-valve conduit, a flexible hose having a first hose end connected to said inlet end of said primary fluid conveyance assembly and having a second hose end which includes a faucet connector, a motor assembly housed with said housing assembly, a power source for powering said motor assembly, a switch assembly connected between said motor assembly and said power source, a drive shaft connected to said motor assembly, and a scrubber head assembly connected to said drive shaft, further including:

a container assembly connected to said housing assembly, wherein said container assembly is used for containing a quantity of an auxiliary fluid, and a feed tube supported by said housing assembly, wherein said feed tube includes an inlet end extending into said container assembly and an outlet end connected to said valve assembly.

12. The apparatus of claim 11 wherein said container assembly includes:

a lid portion connected to said housing assembly, a container portion connected to said lid portion, and a vent tube connected to said lid portion.

13. The apparatus of claim 11 wherein said valve assembly includes:

a flow/dispenser position which permits fluid to flow from said pre-valve conduit to said post-valve conduit and which permits fluid from said feed tube to enter said valve assembly, a shut-off position which prevents fluid from flowing from said pre-valve conduit to said post-valve conduit and which prevents auxiliary fluid from said feed tube from entering said primary fluid, and a venturi structure connected to said feed tube for drawing a quantity of said auxiliary fluid into said valve assembly.

* * * * *